US011251532B2

(12) United States Patent
Yang et al.

(10) Patent No.: US 11,251,532 B2
(45) Date of Patent: Feb. 15, 2022

(54) SMALL DIPOLE ANTENNA

(71) Applicants: IVIEW CO.,LTD., Seoul (KR); KOREA AUTOMOTIVE TECHNOLOGY INSTITUTE, Cheonan-si (KR)

(72) Inventors: Myo Geun Yang, Incheon (KR); Hyok Lee, Cheonan-si (KR)

(73) Assignees: IVIEW CO., LTD., Seoul (KR); KOREA AUTOMOTIVE TECHNOLOGY INSTITUTE, Cheonan-si (KR)

( * ) Notice: Subject to any disclaimer, the term of this patent is extended or adjusted under 35 U.S.C. 154(b) by 0 days.

(21) Appl. No.: 17/054,500

(22) PCT Filed: May 9, 2019

(86) PCT No.: PCT/KR2019/005578

§ 371 (c)(1),
(2) Date: Nov. 10, 2020

(87) PCT Pub. No.: WO2019/216672

PCT Pub. Date: Nov. 14, 2019

(65) Prior Publication Data

US 2021/0194137 A1 Jun. 24, 2021

(30) Foreign Application Priority Data

May 11, 2018 (KR) ..... 10-2018-0054411
Dec. 28, 2018 (KR) ..... 10-2018-0172957

(51) Int. Cl.

| | |
|---|---|
| ***H01Q 9/28*** | (2006.01) |
| ***H01Q 5/48*** | (2015.01) |
| *H01Q 1/32* | (2006.01) |

(52) U.S. Cl.
CPC ..... *H01Q 9/28* (2013.01); *H01Q 5/48* (2015.01); *H01Q 1/3208* (2013.01)

(58) Field of Classification Search
CPC .. H01Q 5/48; H01Q 9/28; H01Q 1/24; H01Q 1/32; H01Q 1/3208; H01Q 1/36;
(Continued)

(56) References Cited

U.S. PATENT DOCUMENTS 3,854,140 A * 12/1974 Ranghelli ..... H01Q 25/001 343/756
4,203,118 A * 5/1980 Alford ..... H01Q 21/20 343/727

(Continued)

FOREIGN PATENT DOCUMENTS

| | | | |
|---|---|---|---|
| JP | 2008-098769 | A | 4/2008 |
| WO | 01-48860 | A1 | 7/2001 |
| WO | 2013-099811 | A1 | 7/2013 |

*Primary Examiner* — Tho G Phan
(74) *Attorney, Agent, or Firm* — Maschoff Brennan

(57) ABSTRACT

The present invention relates to a small dipole antenna, and more specifically, to a small dipole antenna comprising a balun, a meander line, and a cap covering the meander line as a whole, wherein both sides of the dipole antenna are provided with the meander line to minimize the overall size of the dipole antenna. The small dipole antenna according to one embodiment of the present invention obtains resonance frequency adjustment characteristics by filling a gap between the arrangement of the meander line disposed on the both sides of the dipole antenna on the basis of the balun and the meander line, and adds a short circuit between the meander line to achieve impedance matching and minimize the overall size of the dipole antenna structure at the same time, thereby having the effect of ensuring tractability of antenna operation regardless of external conditions when measuring electromagnetic wave performance.

8 Claims, 14 Drawing Sheets

(58) Field of Classification Search
CPC .. H01Q 1/40; H01Q 9/16; H01Q 9/26; H01Q 9/285; H01Q 9/30
See application file for complete search history.

(56) References Cited

U.S. PATENT DOCUMENTS

| | | | | |
|---|---|---|---|---|
| 5,754,143 | A * | 5/1998 | Warnagiris | H01Q 1/36 343/746 |
| 7,463,209 | B2 * | 12/2008 | Tang | H01Q 9/285 343/795 |
| 9,837,722 | B2 * | 12/2017 | Minard | H01Q 1/2291 |
| 2007/0188399 | A1 | 8/2007 | Rickenbrock | |
| 2009/0195667 | A1 | 8/2009 | Schofield, Jr. | |
| 2014/0320367 | A1 * | 10/2014 | Alkhateeb | H01Q 1/38 343/804 |

* cited by examiner

SMALL DIPOLE ANTENNA

FIELD OF INVENTION

The present invention relates to a small dipole antenna, and more particularly, to a small dipole antenna provided with a balun, a meander line and a cap to cover a whole of the meander line, wherein the meander line is provided on both sides of the dipole antenna so as to reduce the overall size of the dipole antenna.

BACKGROUND OF INVENTION

Broadband antennas widely used in the art include biconical antennas, elliptical monopole antennas, flat-shaped diamond antennas, notch antennas, bow tie type antennas that can be directly installed on PCBs, rigid horn antennas, conical horn antennas, forward coaxial horn antennas, Lomvik antennas, logarithmic antennas, spiral antennas, and the like.

Thereamong, an antenna for electromagnetic interference (EMI) evaluation is often used in a defined space such as the inside of a building, a hull, an airplane, a vehicle, etc. However, the conventional broadband antenna described above may use a thick element or may have a broadening structure in a triangular form, a structure in which a transmission line itself spreads, a structure in which elements with different sizes are arranged, or a structure in which elements are arranged in a round form. Therefore, it is difficult to carry the antenna due to very large volume thereof, thus causing a problem of difficulty in using the same for measurement of electromagnetic waves.

Further, for an antenna for measuring electromagnetic waves, it is important for the antenna to be affected as little as possible by the surrounding environment, in particular, ground conditions. For this purpose, a dipole antenna is preferably used rather than a monopole antenna.

Therefore, there is a need for development of a small dipole antenna which a new structure having a reduced size, which is easy to use and can accurately measure an electromagnetic environment.

SUMMARY OF INVENTION

Technical Problem to be Solved

The present invention has been devised to meet the requirements as described above, and an object of the present invention is to provide a small dipole antenna by reducing overall size of a dipole antenna structure so as to easily implement functions of the antenna in measurement of electromagnetic wave performance regardless of an environment in which the antenna is used.

The object of the present invention is not limited to that mentioned above and other objects not mentioned herein will be clearly understood from the following description by those skilled in the art.

Technical Solution

A small dipole antenna according to an embodiment of the present invention to solve the above problem may be provided together with a configuration of: a connector formed on one end of the dipole antenna; a balun formed on one side of the connector; a first meander line, one side of which is fixed to one end of the balun; a second meander line, one side of which is fixed to one end of the balun; a filling member to fill a space of a bent portion of a curved portion in the first meander line or the second meander line; and a cap to cover the first meander line and the second meander line.

In this case, a bundle connected to the balun, that is, a bundle including the first meander line, the second meander line, a cover, etc. is called an antenna unit.

The balun and the antenna unit are preferably coupled with a knob or a screw.

The first meander line or the second meander line may extend not to be parallel to a heading (or traveling) direction of the balun with respect to the balun, and may be provided with at least one bent portion or curved portion.

One or more filling members may be provided, and the filling members preferably have the same or different sizes.

The cap may include a switch part to open or close a predetermined area covering the first meander line or the second meander line.

In this case, the small dipole antenna may further include a short stub to connect the first meander line and the second meander line.

Effect of Invention

With regard to the small dipole antenna according to an embodiment of the present invention, the configuration of the meander line extending in both sides with respect to the balun, as well as the filling member in a predetermined size used to fill a gap between the meander lines, may obtain resonance frequency adjustment characteristics. Further, adding a short stub between the meander lines may achieve impedance matching. At the same time, an overall size of the dipole antenna structure can be desirably reduced to ensure easy antenna operation regardless of external conditions when determining electromagnetic wave performance.

Effects of the present invention are not limited to those mentioned above, and other effects not mentioned herein will be clearly understood from the following description by those skilled in the art.

DETAILED DESCRIPTION OF PREFERRED EMBODIMENTS OF INVENTION

Figure 1:
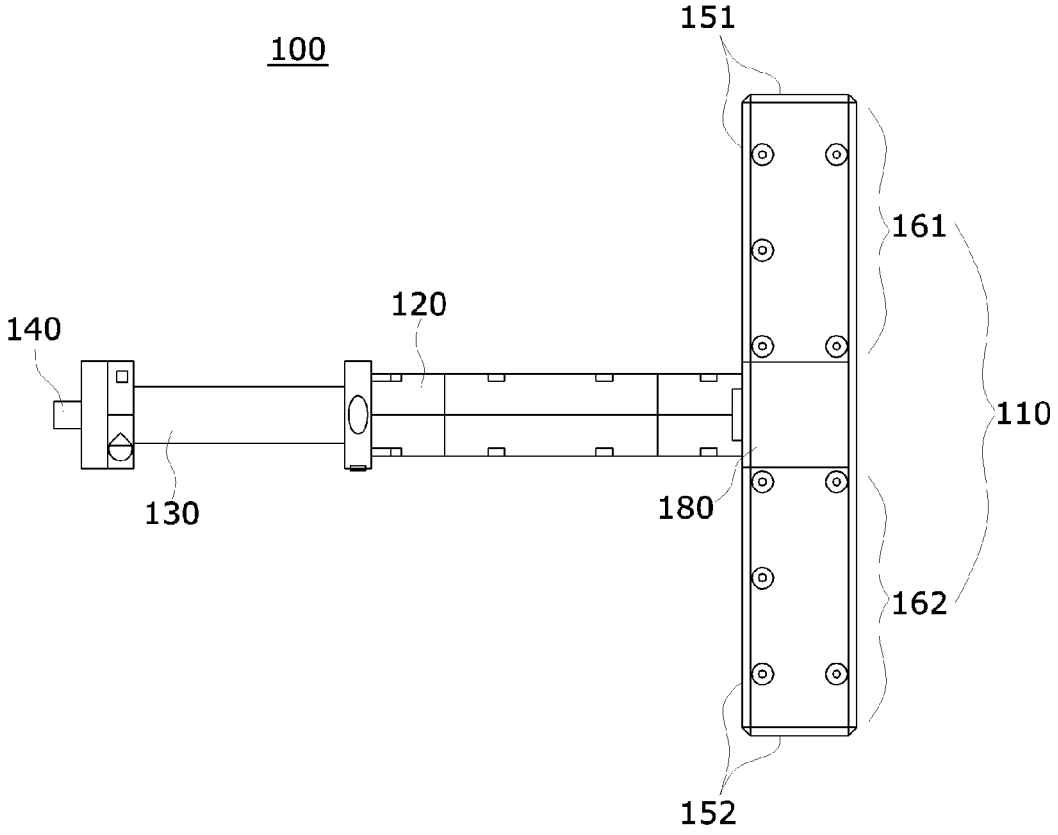
FIG. 1 is one side view of a dipole antenna according to an embodiment of the prior art.

Objects and effects of the present invention and technical configurations for achieving the same will be apparent with reference to the embodiments described later in detail in conjunction with the accompanying drawings. In describing the present invention, if it is considered that description of known functions or configurations may unnecessarily obscure the gist of the present invention, the detailed description thereof will be omitted. The terms described later are terms defined in consideration of structures, roles, functions, and the like in the present invention, which may vary according to intentions of users or operators or customs in the art.

However, the present invention is not limited to the embodiments disclosed below but may be implemented in various forms. The present embodiments are merely provided to complete the disclosure of the present invention, and to fully inform the scope of the invention to those skilled in the art. Therefore, the present invention is only defined by the range described in the appended claims. Accordingly, the definition should be made based on the contents throughout the specification.

In the whole specification, when a part is said to "include" a certain component, it means that the part may further include other components without excluding the same unless specifically stated otherwise.

The present invention provides a dipole antenna having a frequency band of 146 to 174 MHz, which is available in the international standard for immunity test (ISO11452-9) [1] to verify malfunction by applying the radio waves generated from portable devices such as clock radios, mobile phones, Wi-Fi, etc. used in the vehicle to automobile electronics.

The antenna presented in the current standard is a vertical mode monopole type helical antenna, and may have resonance frequency and radiation pattern possibly varying under influences of setup and the surrounding ground. Therefore, in order to overcome this problem, the inventor of the present invention has devised a folded dipole antenna which is less affected by the ground.

ISO11452-9 international standard is used in a tolerance test, that is, immunity assessment that determines malfunction by applying radio waves generated from various portable transmitters used in the vehicle, for example, clock radios, mobile phones, Wi-Fi, etc., to automobile electronics, and is currently modified and utilized by North American vehicle manufacturers (GM, Ford, Daimler), European vehicle manufacturers (Volkswagen, Volvo, Renault, etc.), and Japanese vehicle manufacturers (Nissan, etc.). Component suppliers for these vehicle manufacturers should perform immunity assessment.

ISO11452-9 standard proposes an evaluation antenna for each frequency and a vertical mode monopole type helical antenna in the frequency band of 146 to 174 MHz.

However, since the characteristics of the monopole antenna are influenced by the surrounding ground and are also affected by a coaxial cable for feeding, test setup, EUT and a position of the measurement instrument, not only are antenna characteristics such as RL (Return Loss) and VSWR but also resonance frequency and field (radiation pattern) are changed. As a result, the desired E-field strength cannot be acquired at the corresponding frequency.

Figure 8:
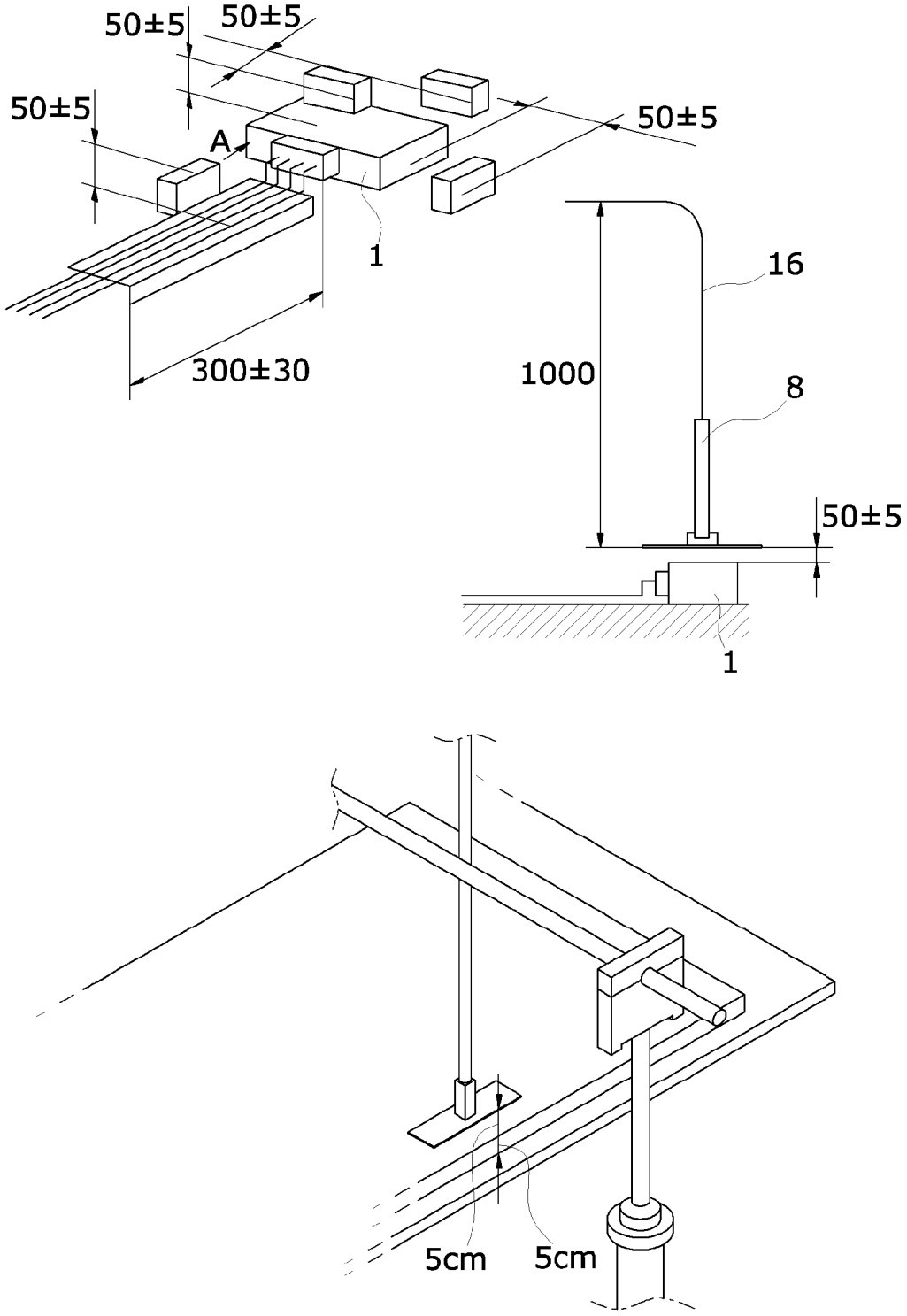
FIG. 8 is a view for explaining a test setup specified in ISO.

FIG. 8 illustrates a situation in which the test setup specified in ISO is reproduced. Herein, the antenna is positioned on 10 cm above a GND plane above 5 cm EUT, and characteristics are modified under the above influences.

In order to solve such problems, the present invention intends to develop and propose a dipole antenna which is independent of GND of antenna feeding and is applicable to a surrounding ground environment such as a GND table.

The dipole antenna of the present invention may apply a miniaturization technique to a typical dipole antenna. Each pole in the antenna is designed as a meander according to the miniaturization technique, and a frequency adjustment point is designed as a physical length of the meander. In this regard, a configuration of the meander has been designed such that vector directions or current are orthogonal to each other so as to minimize current loss while both ends are covered with caps.

In order to reduce capacitance caused by the meander and the cap, a short stub may be added to a beginning part of the pole, thus performing impedance matching.

Hereinafter, with reference to the accompanying drawings, preferred embodiments of the present invention will be described in detail.

The present invention provides a small dipole antenna including a balun, a meander line and a cap to entirely cover the meander line, wherein the meander line is provided on both sides of the dipole antenna in order to decrease an overall size of the dipole antenna. For comparison, the conventional dipole antenna shown in FIG. 1 will be concretely described.

The conventional dipole antenna 100 shown in FIG. 1 is configured of an antenna structure 110, a bar-shaped enclosure 120 connected to one face of the antenna structure 110 at one end of the enclosure, a rod shaped handle 130 extending from the other end, and a connector 140 mounted at an end of the handle 130.

First, the antenna structure 110 may be made of a material containing a metal component, and the above metal component may constitute a metal workpiece or an electronic circuit board. The electronic circuit board may be composed of glass, ceramic, synthetic resin, a printed circuit board (PCB) and the like, and the antenna made of a metal component may include two poles based on the characteristics of the dipole antenna, wherein both poles preferably have a symmetrical structure.

The two poles are named first and second antennas 161 and 162. The first antenna 161 and the second antenna 162 may be formed of a metal material, and may be provided to be in contact with the electronic circuit board or the dielectric body 180 on one face and the other face thereof.

Specifically, the first antenna 161 and the second antenna 162 are formed on one surface of the electronic circuit board and spaced apart from each other at a predetermined interval. The first antenna 161 and the second antenna 162 may be formed symmetrically with respect to the center of the electronic circuit board, and may be made of a conductor such as copper, bronze, gold, and silver. The first and second antennas 161 and 162 may be manufactured in a desired pattern by applying a general method such as printing, lithography and etching to one surface of the electronic circuit board or the dielectric body 180, or a printed circuit board (PCB). Alternatively, a printed circuit board (PCB) may be adopted and mounted on the dielectric body 180 or the electronic circuit board.

Meanwhile, each of the first and second antennas 162 may further include a first feed member 1 and a second feed member 2. Specifically, each of the first feed member 1 and the second feed member is connected to a first antenna body 151 or a second antenna body 152 and extends from the connected antenna toward the other antenna, wherein both feed members are spaced apart from each other at a predetermined interval.

That is, such a configuration in which the first feed member extends toward the second antenna body 152 and the second feed member extends toward the first antenna body 151, wherein these feed members are formed on the electronic circuit board while being spaced apart from each other at random intervals, can be confirmed. As shown in the drawings, it can be seen that the dipole antenna extends vertically in a considerable length from a heading direction of the enclosure 120 and the handle 130, and therefore, it can be confirmed that the above configuration has difficulty in achieving miniaturization.

Hereinafter, the dipole antenna of the present invention, which is different from the conventional dipole antenna of FIG. 1, will be described in detail with reference to FIGS. 2 to 19.

Figure 2:
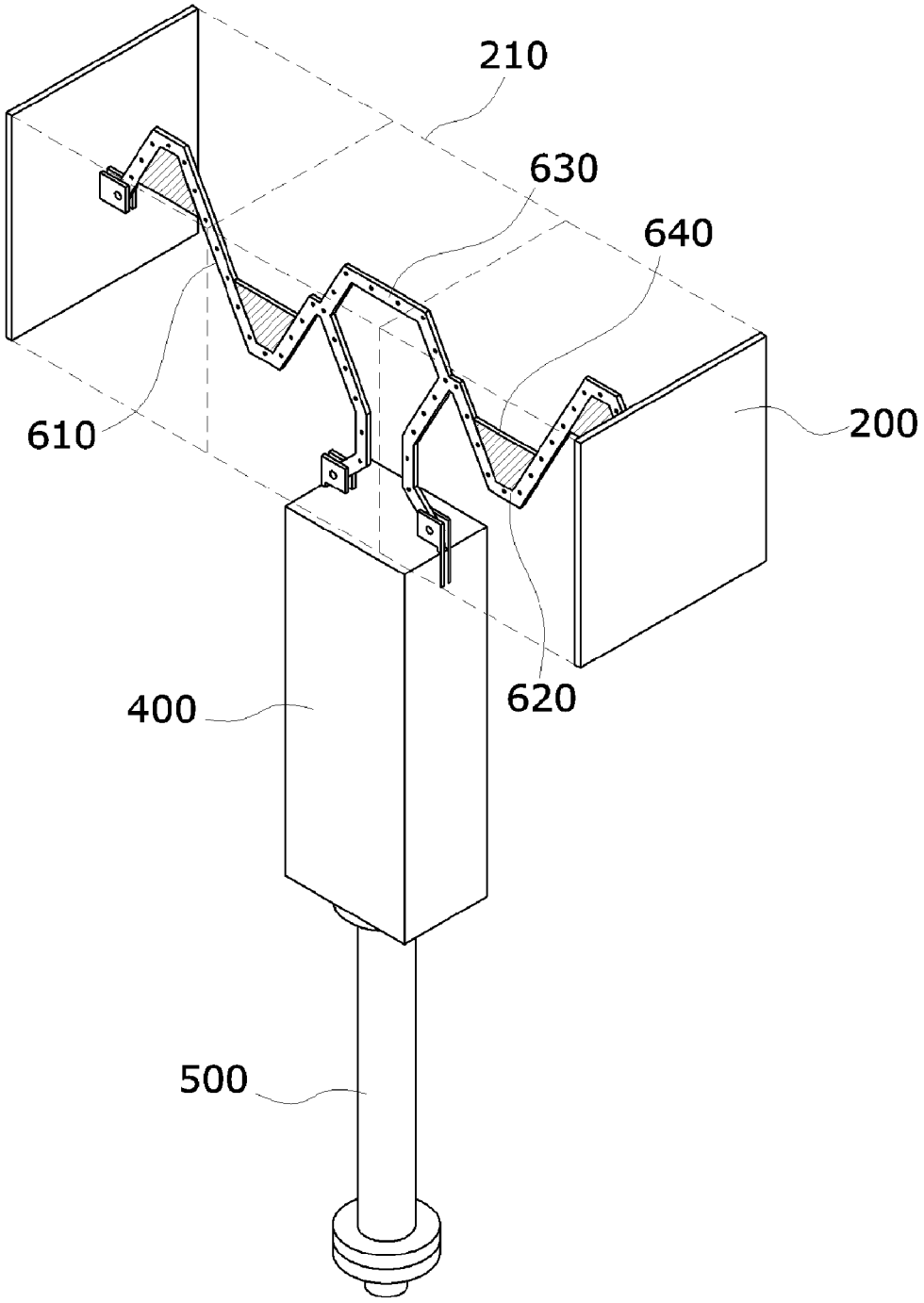
FIG. 2 is a perspective view illustrating an open state of multiple faces of a small dipole antenna cap according to an exemplary embodiment of the present invention.
Figure 3:
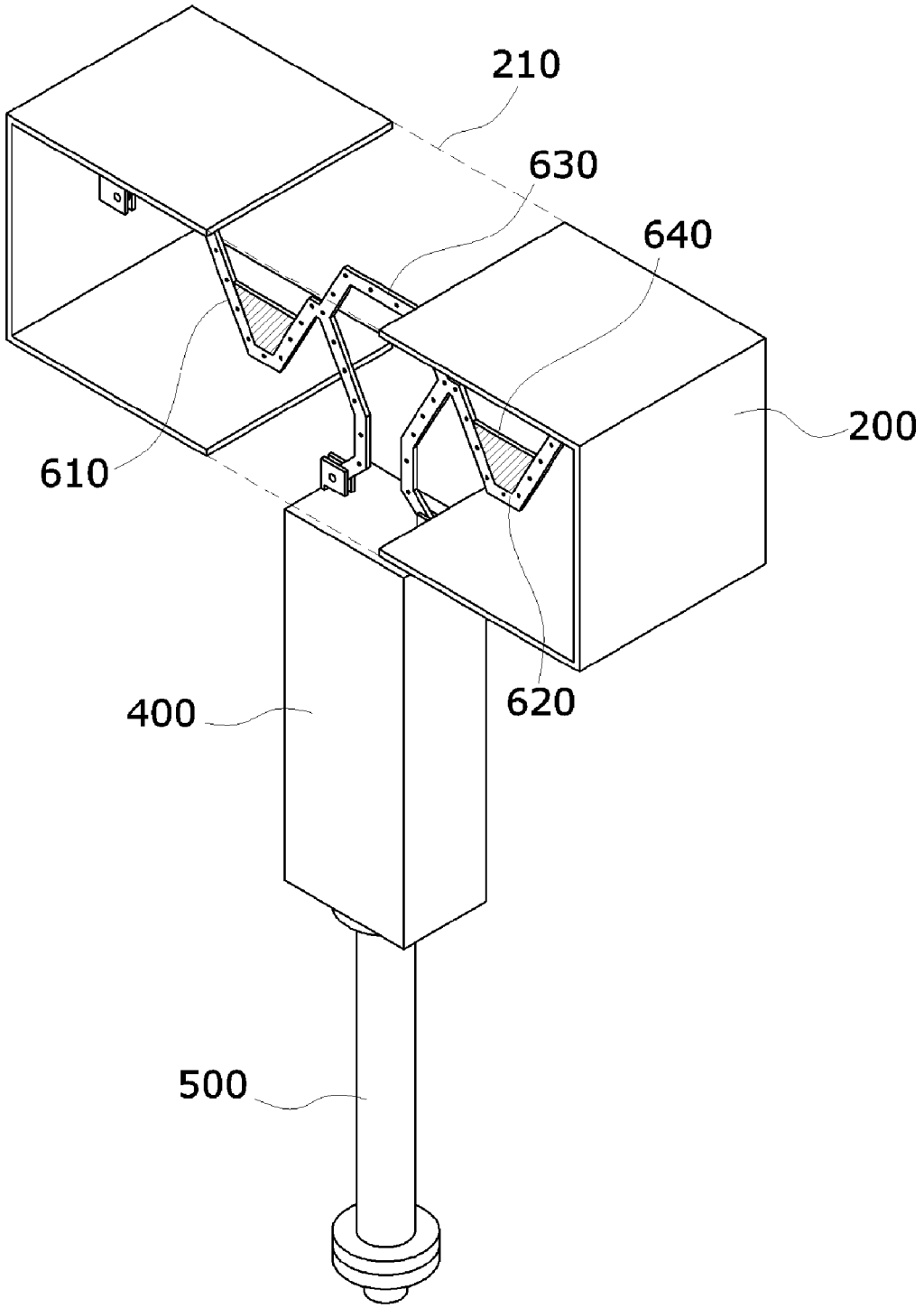
FIG. 3 is a perspective view illustrating an open state of multiple faces of a small dipole antenna cap according to another exemplary embodiment of the present invention.
Figure 4:
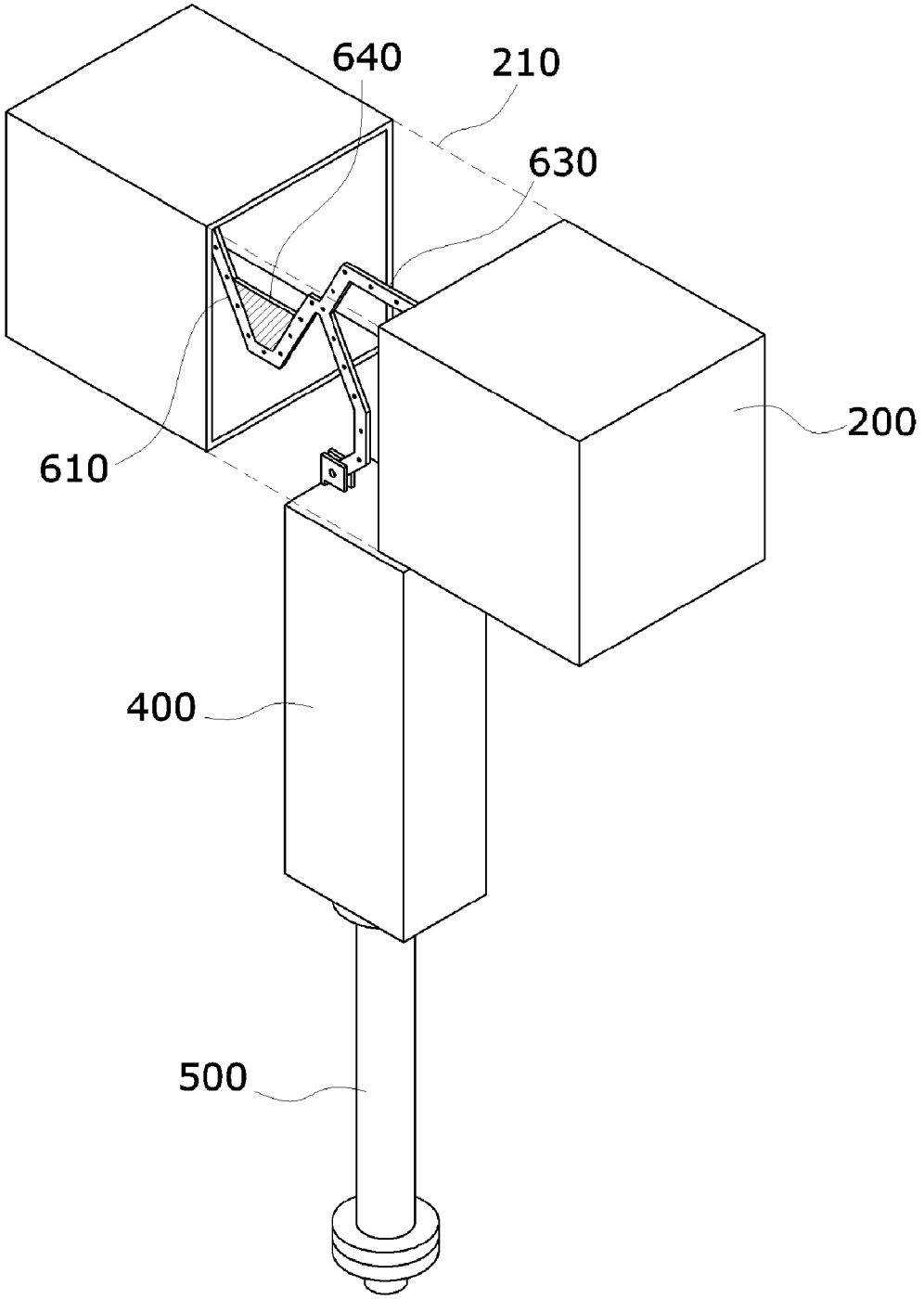
FIG. 4 is a perspective view illustrating an open state of multiple faces of a small dipole antenna cap according to another exemplary embodiment of the present invention.
Figure 5:
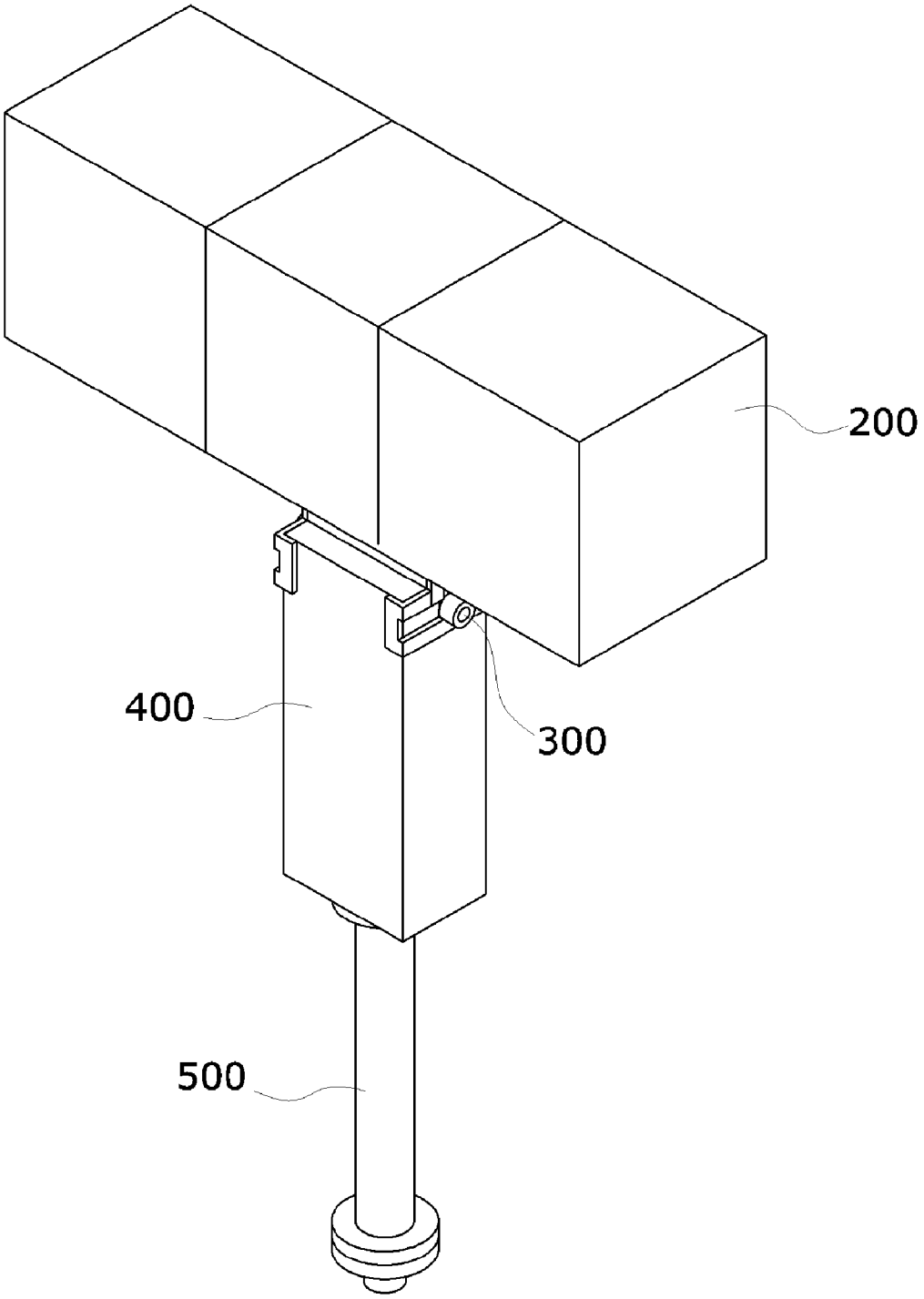
FIG. 5 is a perspective view of a small dipole antenna according to an embodiment of the present invention.

FIGS. 2 to 4 are perspective views illustrating an open state of the multiple faces of the small dipole antenna cap according to one embodiment of the present invention, and FIG. 5 is a perspective view of the small dipole antenna according to another embodiment of the present invention.

Referring to FIG. 5, it is possible to confirm the overall configuration of the small dipole antenna according to the present invention, except that the cap of the small dipole antenna is entirely closed, which is different from the small dipole antenna in an open state according to the embodiment shown in FIGS. 2 to 4.

As shown in FIGS. 2 to 4, the small dipole antenna having a configuration of: a connector 500 formed on one end of the dipole antenna; a balun 400 formed on one side of the connector 500; a first meander line 610, one side of which is fixed to one end of the balun 400; a second meander line 620, one side of which is fixed to one end of the balun 400; a filling member 640 to fill a space of a bent portion or curved portion in the first meander line 610 or the second meander line 620; and a cap to cover the first meander line 610 and the second meander line 620, can be confirmed. Herein, the balun 400 and the antenna unit may be coupled by a knob 300.

In this case, when a circuit parallel to the ground is coupled to an amplification circuit having one grounded end, the balun 400 may prevent ground balance of the parallel circuit from collapsing or may refer to a matching transformer, which is used to connect the ground-parallel circuit to an unbalanced circuit such as a coaxial cable in a very high frequency (VHF) transmission circuit. Further, the balun is a portmanteau of "balanced" and "unbalanced", and may have an impedance conversion function based on features of the balun 400.

According to a configuration of the knob 300, effects of easily attaching and detaching the antenna unit through a simple structure, which is easy to couple the antenna unit and the balun 400 or the like, can be achieved.

Referring to FIGS. 2 to 4, it can be seen that the cap member 200 constituting the antenna unit is partially opened and closed in the small dipole antenna configuration according to the present invention.

A portion of the cap 200 to be opened and closed is called a switch part 210. Although the switch part 210 is shown as empty in FIGS. 2 to 4, the switch part 210 is actually made of a plastic material. The term "switch part" is used because that part is made of a plastic material that does not interfere with the emission of radio waves.

The switch part 210 can open and close a predetermined portion of the first meander line 610 or the second meander line 620, thereby enabling effects of adjusting resonant frequency characteristics of the dipole antenna.

As shown in FIGS. 2 to 4, opening and closing the switch part 210 preferably changes the corresponding region differently, thus adjusting resonance frequency characteristics of the small dipole antenna.

Figure 6:
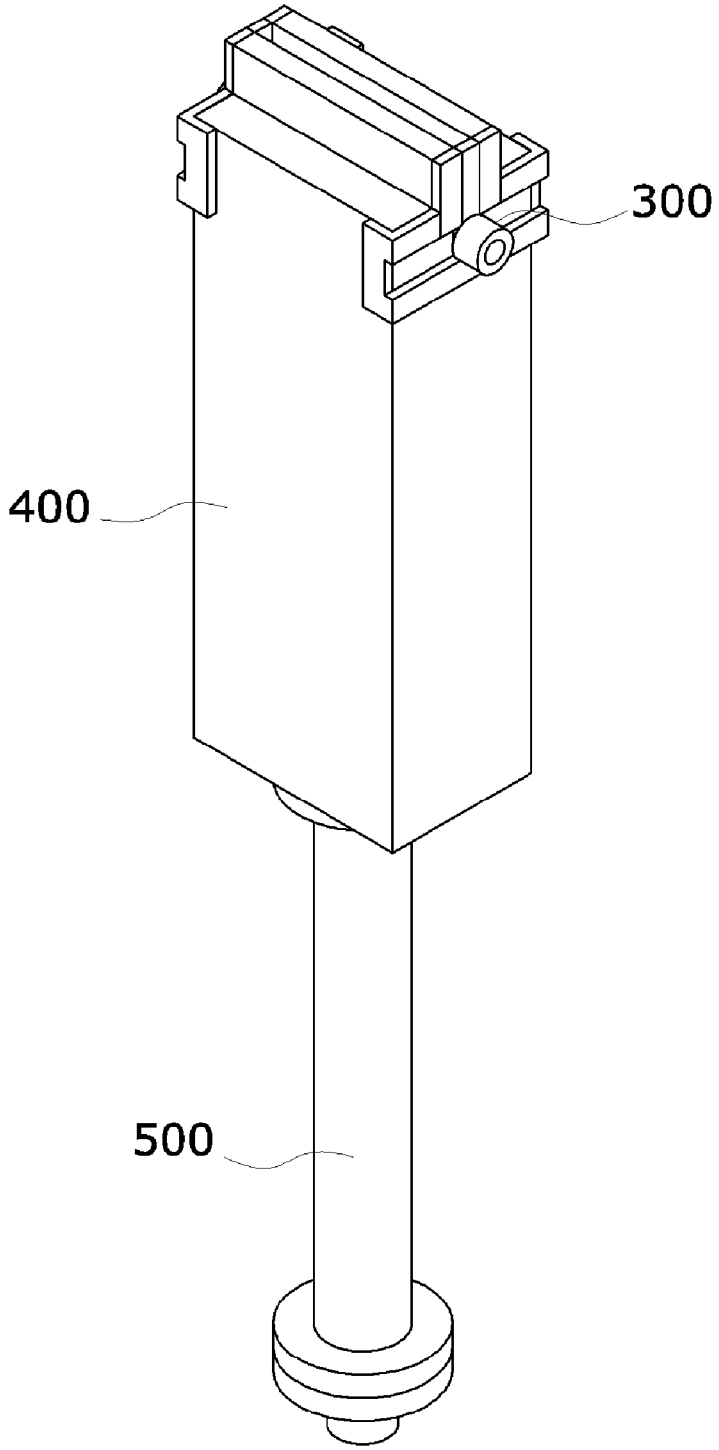
FIG. 6 is a perspective view illustrating a knob, a balun and a connector of the small dipole antenna according to an embodiment of the present invention.
Figure 7:
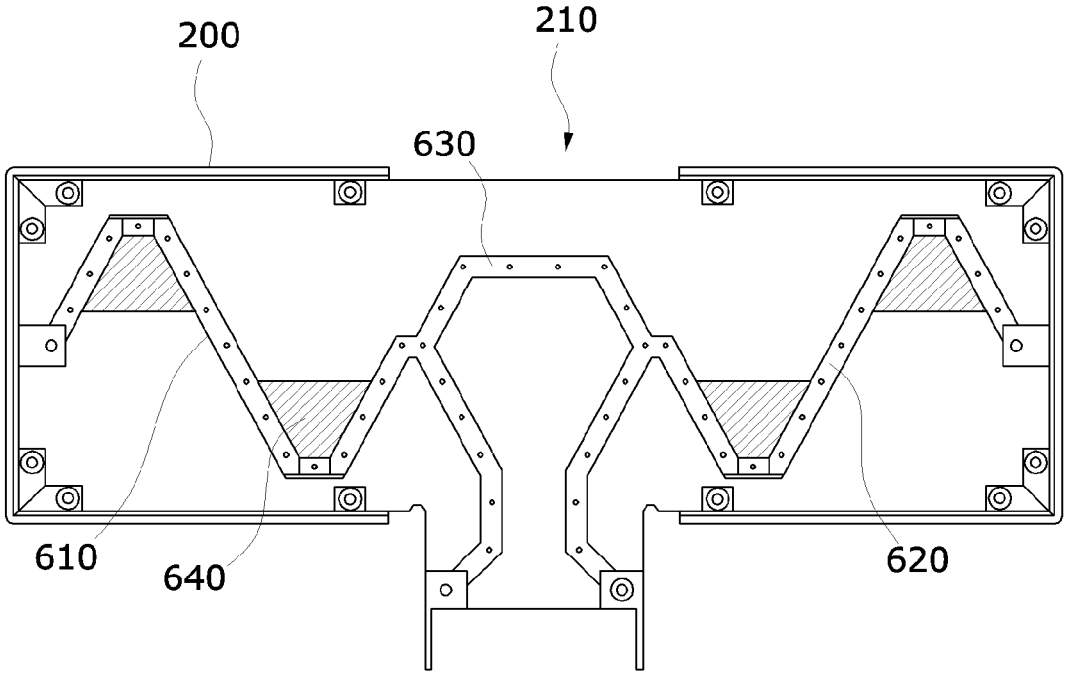
FIG. 7 is a front sectional view of an antenna unit in the small dipole antenna according to an embodiment of the present invention.

FIG. 6 is a perspective view showing a knob, a balun and a connector of the small dipole antenna according to an embodiment of the present invention, and FIG. 7 is a front sectional view showing an antenna unit of the small dipole antenna according to an embodiment of the present invention.

Referring to FIGS. 6 and 7, it is specifically confirmed that, in order to achieve the main purpose of the present invention, the first meander line 610 and the second meander line 620 are included to establish miniaturization of the dipole antenna.

More specifically, the first meander line 610 or the second meander line 620 extends not to be parallel to a heading direction of the balun 400 with respect to the balun 400, and is preferably provided with at least one bent portion or curved portion.

Further, the filling member 640 is made of the same metal material as the meander line. Specifically, at least one filling member is provided in the same or different size. Specifically, resonance frequency characteristics of the small dipole antenna can be adjusted depending on the number and size of the filling members.

In addition, a short stub 630 connecting the first meander line 610 and the second meander line 620 may be further included so as to easily perform impedance matching through a simple structure.

FIGS. 9 to 13 illustrate structures of respective small dipole antennas with different frequency bands according to the present invention.

Figure 9:
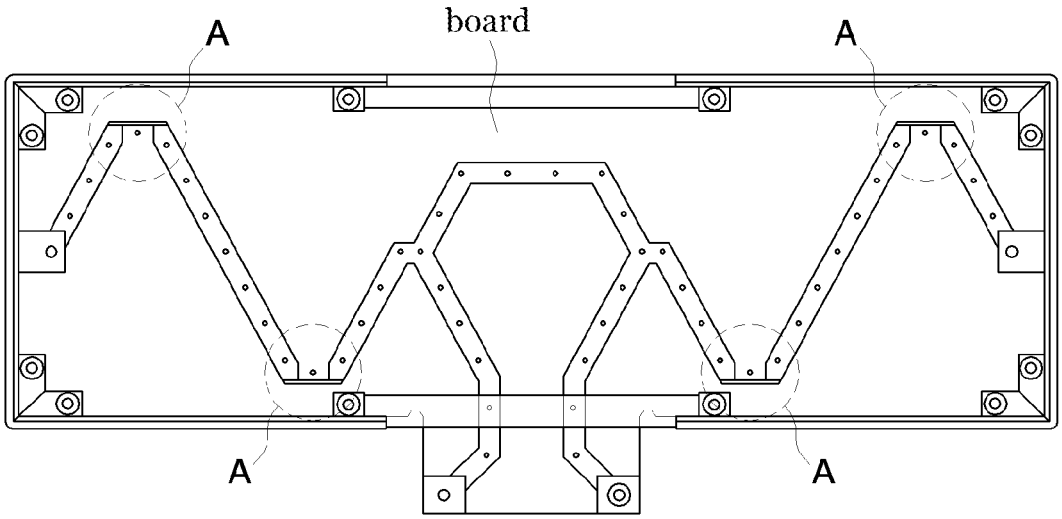
FIGS. 9 to 13 illustrate structures of respective small dipole antennas with different frequency bands according to the present invention.
Figure 10:
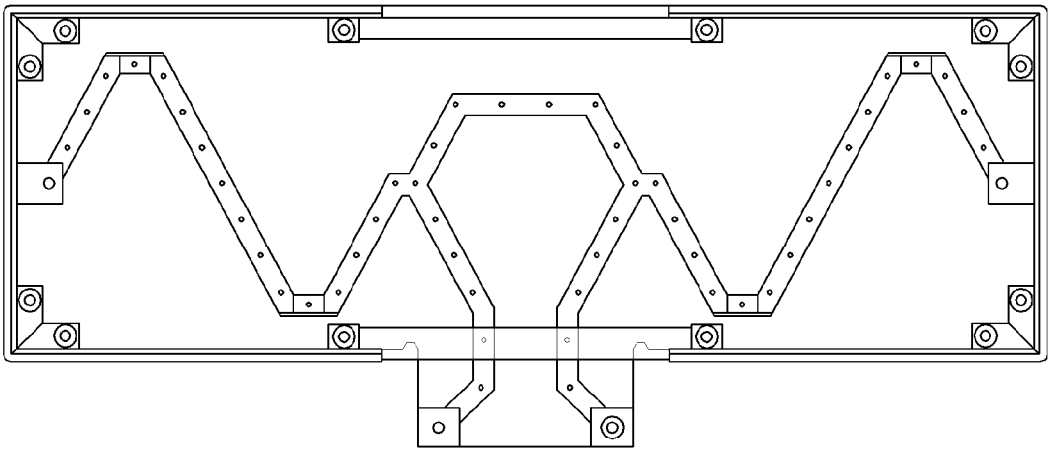
Figure 11:
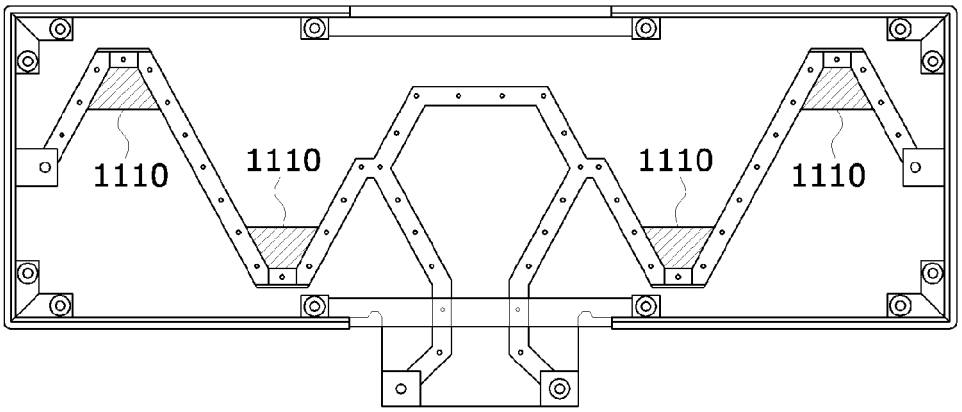
Figure 12:
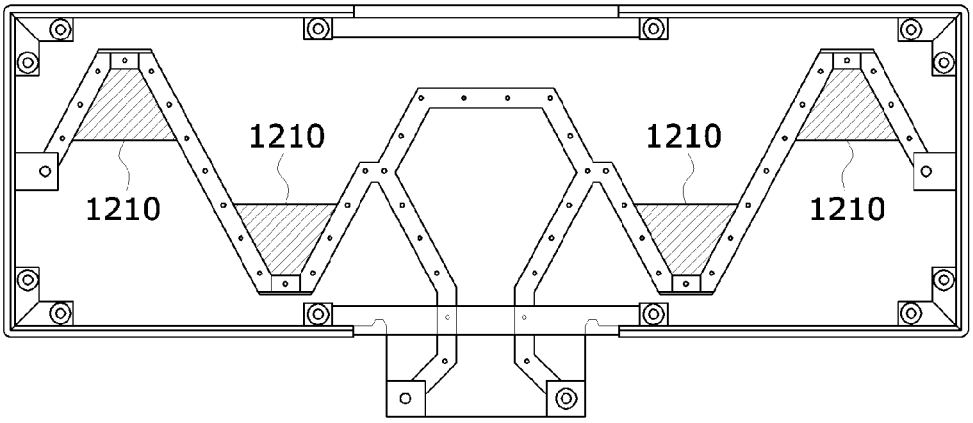
Figure 13:
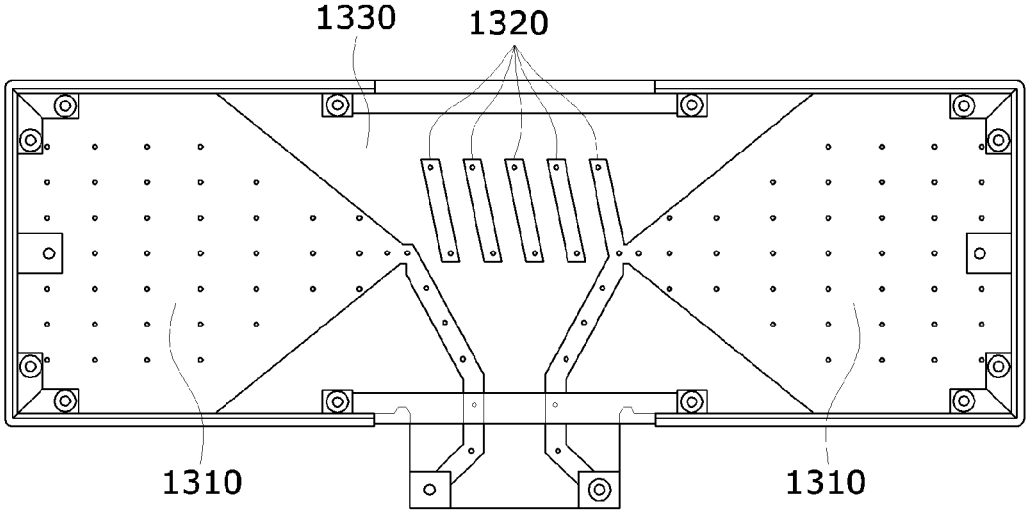
Figure 14:
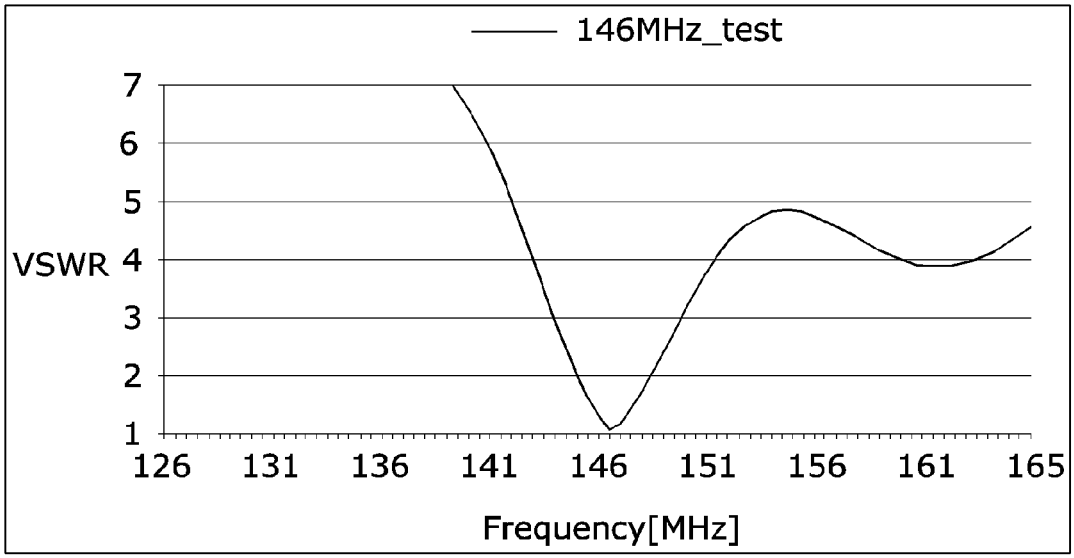
FIGS. 14 to 18 are graphs showing VSWR characteristics of five different antennas shown in FIGS. 9 to 13.
Figure 15:
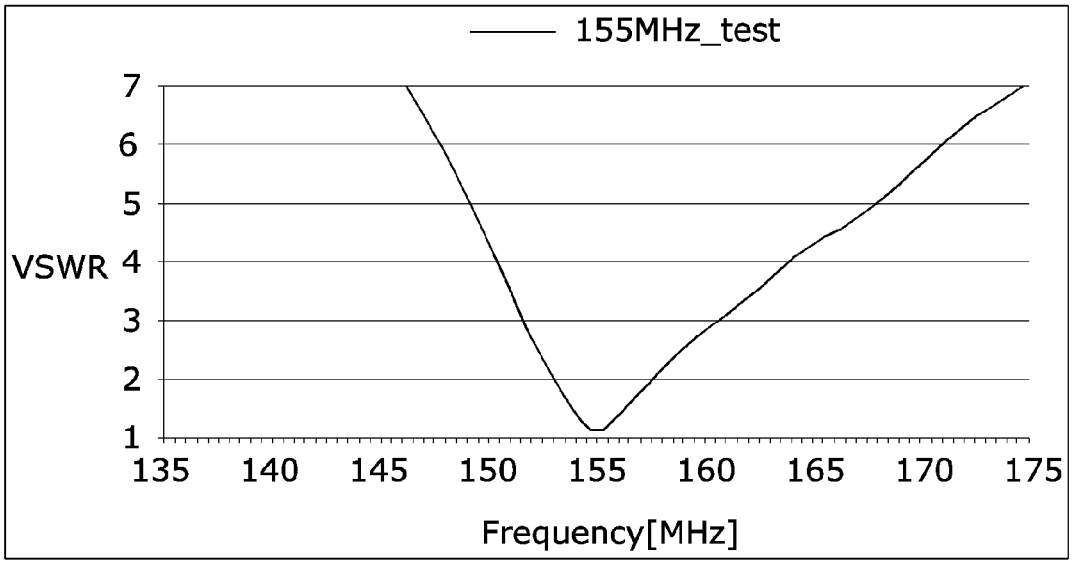
Figure 16:
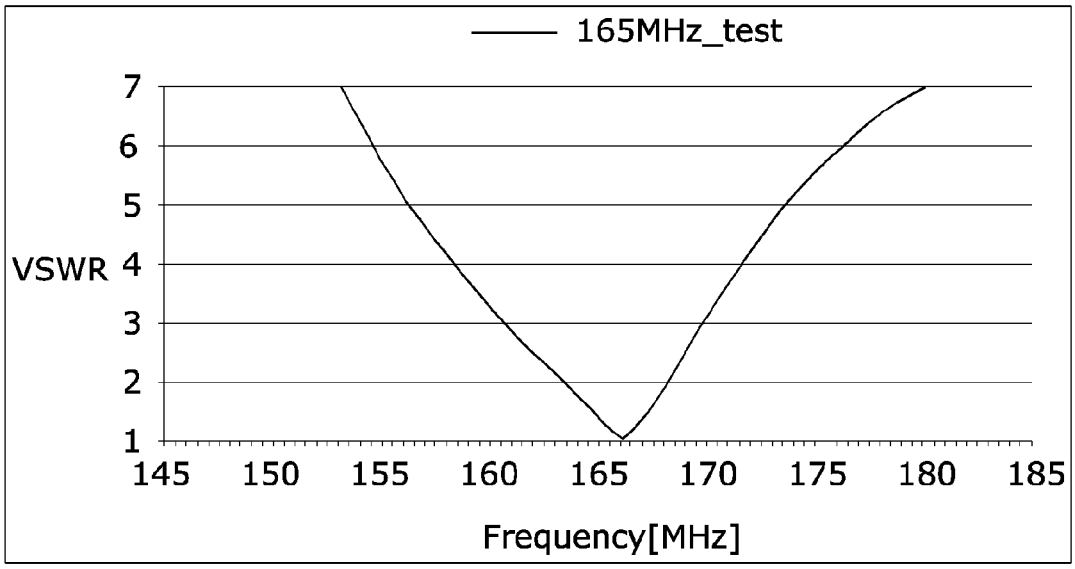
Figure 17:
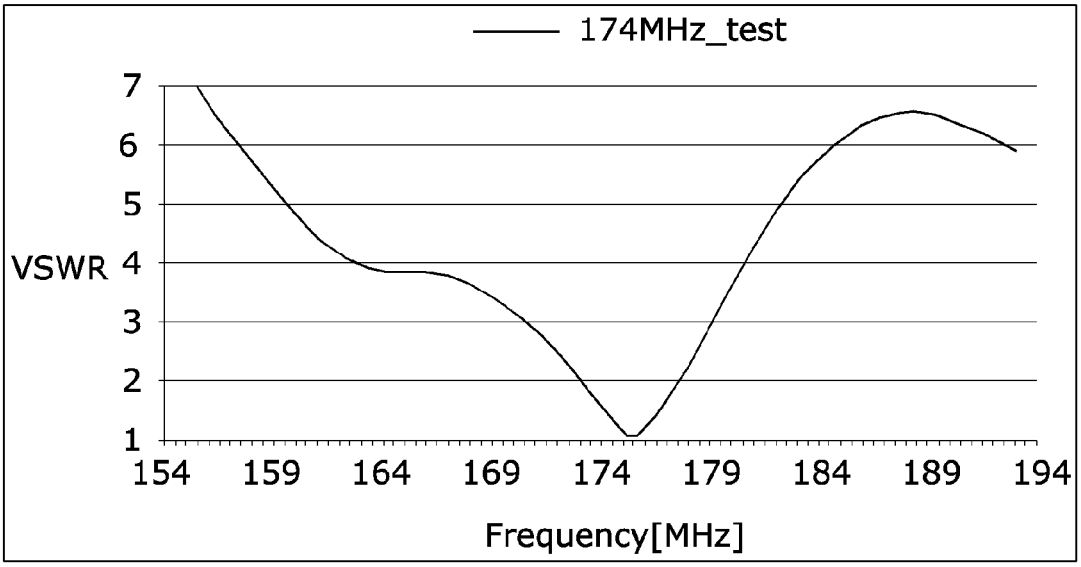
Figure 18:
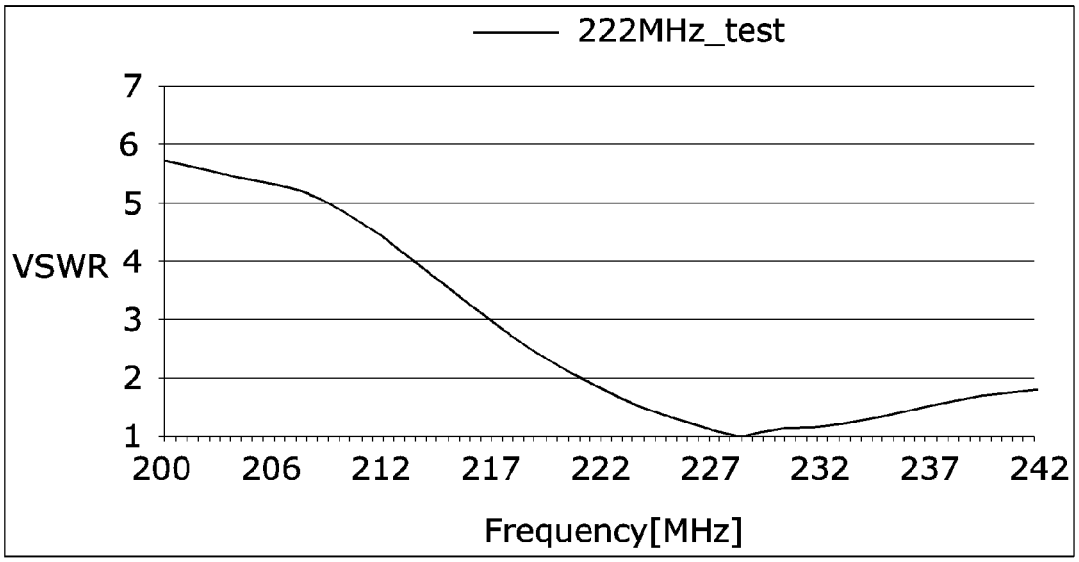

FIG. 9 shows an antenna structure having a center frequency (resonant frequency) in a 146 MHz band, FIG. 10 shows an antenna structure having a center frequency (resonant frequency) in a 156 MHz band, FIG. 11 shows an antenna structure having a center frequency (resonant frequency) in a 165 MHz band, and FIG. 12 shows an antenna structure having a center frequency (resonant frequency) in a 174 MHz band. Further, FIG. 13 shows an antenna structure having center frequency (resonant frequency) in a 222 MHz band.

As shown in FIGS. 9 to 13, the center frequency (resonant frequency) may be tuned by adjusting a length of the meander or a physical length of the meander while varying a size of the filling member. For example, the meander length of the dipole antenna shown in FIGS. 9 and 10 without a filling member is relatively longer than the meander length of the small dipole antenna shown in FIGS. 11 and 12. In this case, the bent portion A of the small dipole antenna shown in FIG. 9 may be connected by a line having a thinner thickness than another line, which is used to connect the bent portion A of the small dipole antenna shown in FIG. 10.

Alternatively, the bent portion A of the small dipole antenna shown in FIG. 9 may be connected by a via (path, not shown) passing through the board and a pattern formed on the back of the board. Thus, when comparing FIGS. 9 and 10, the antenna length in FIG. 9 is longer than the antenna length in FIG. 10. When the bent portion A is connected by the via, the antenna length in FIG. 9 is longer by vias (8 vias) than the antenna length in FIG. 10.

When comparing the dipole antennas between FIG. 11 and FIG. 12, there is a difference in that a size of the filling member 110 of the dipole antenna in FIG. 11 is smaller than that of the filling member 1210 of the dipole antenna in FIG. 12. Thus, when comparing physical lengths thereof, the length of the dipole antenna of FIG. 11 is longer than the length of the dipole antenna of FIG. 12.

The dipole antenna in FIG. 13 has a plate-shaped meander line 1310 (in a sector form) at both ends, and the plate-shaped meander line 1310 is connected by a short stub 1320 patterned in a slashed line shape. Although the short stub 1320 appears to be separated in the figure, it is actually connected by a via (not shown) and an antenna pattern formed on the back of the board 1330.

Table 1 below shows antenna characteristics obtainable in five types of antennas shown in FIGS. 9 to 13, while FIGS. 14 to 18 are graphs showing VSWR features of the five types of antennas.

TABLE 1

| Trans-mitter | Frequency band MHz | Center frequency MHz | VSWR | SIZE | Etc. |
|---|---|---|---|---|---|
| 2mLand Mobile | 144-150<br>152-160<br>162-174<br>174-180<br>215-246 | 146<br>156<br>165<br>174<br>222 | ≤ 2@center)<br>≤ 3@BW ) | 240 x 90 x 360 mm | −Gain > −1 dBi-Input impedance: 50 Ω-Max input power: 30 W-Connerctor: N-female |

Figure 19:
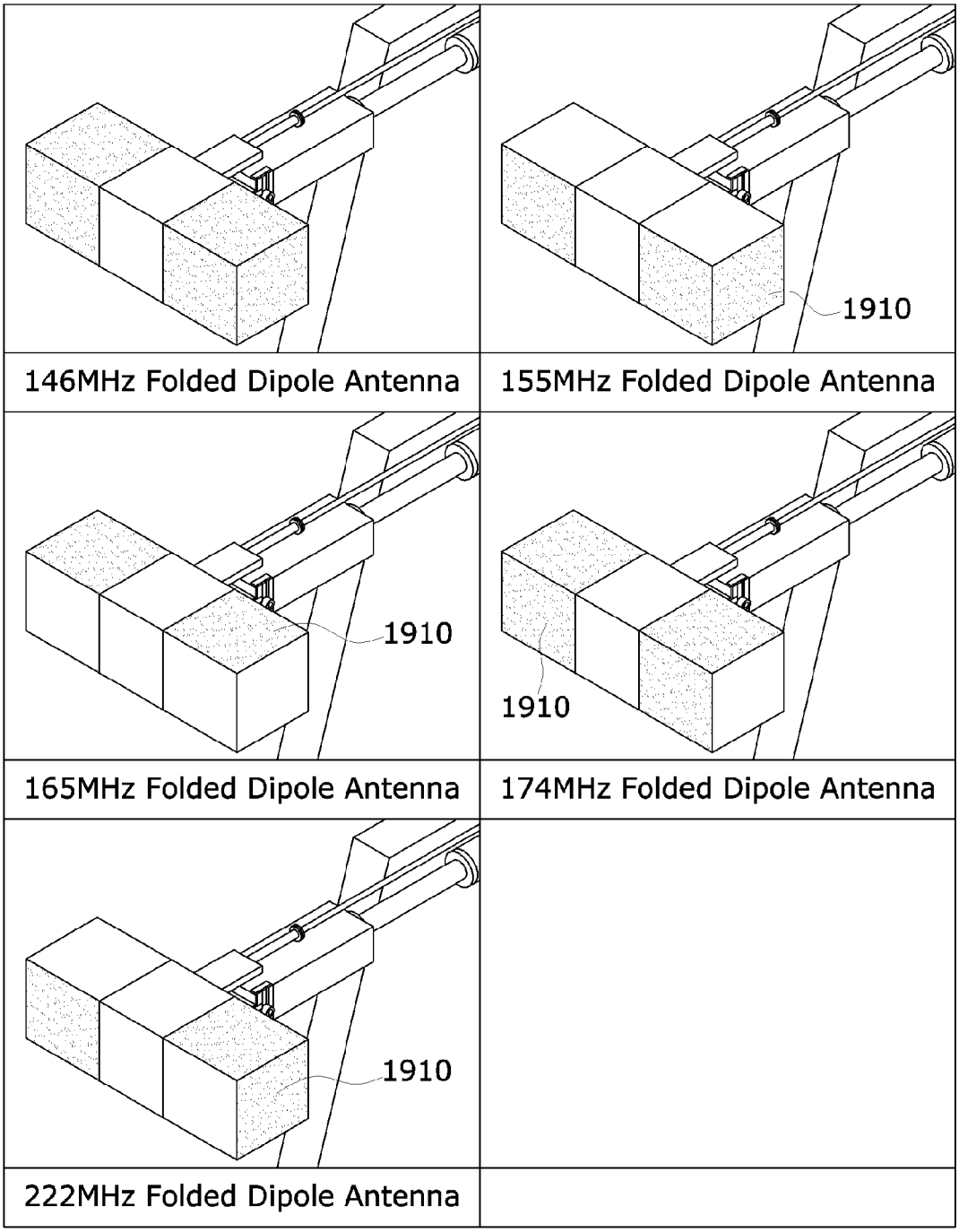
FIG. 19 is photographs showing shapes of the caps in the dipole antennas with different frequency bands according to an embodiment of the present invention.

As shown in FIGS. 14 to 18, it can be seen that each antenna has RL (Return loss) 6 dB (VSWR 3:1) and a bandwidth of about 6 (4.1%) to 11 MHz (6.7%) so that relatively good band characteristics can be obtained. FIG. 19 is photographs showing shapes of the caps in the dipole antennas with different frequency bands according to an embodiment of the present invention.

In FIG. 19, the cap shape of each of the dipole antennas with different frequency bands is shown. In four dipole antennas except for the dipole antenna having 146 MHz center frequency, some among five faces constituting the cap may be made of a plastic material, thereby achieving an advantage of widening the frequency band while reducing cost due to use of the metal material. In the drawing, no-slashed faces are made of plastic while the slashed face 1910 is made of metal.

As described above, although embodiments of the present invention have been described, those skilled in the art would diversely alter or modify the present invention by adding, changing of deleting components within the range without departing from the spirit of the present invention described in the appended claims. Further, it should be understood that such alteration or modification is within the scope of the present invention.

The invention claimed is:

1. A small dipole antenna, comprising:

a connector formed on one end of the dipole antenna; a balun formed on end side of the connector; a first meander line, one side of which is fixed to one end of the balun; a second meander line, one side of which is fixed to one end of the balun;

a filling member to fill a space of a bent portion or a curved portion of the first meander line or the second meander line; and a cap to cover the first meander line and the second meander line.

2. The antenna according to claim 1, wherein the balun and an antenna unit are coupled by a knob.

3. The antenna according to claim 1, wherein the first meander line extends not to be parallel to a heading direction of the balun with respect to the balun, and is provided with at least one bent portion or curved portion.

4. The antenna according to claim 3, wherein one or more filling members are provided and have the same or different size.

5. The antenna according to claim 1, wherein the second meander line extends not to be parallel to a heading direction of the balun with respect to the balun, and is provided with at least one bent portion or curved portion.

6. The antenna according to claim 5, wherein one or more filling members are provided and have the same or different size.

7. The antenna according to claim 1, wherein the cap includes:

a switch part able to open or close a predetermined area to cover the first meander line or the second meander line.

8. The antenna according to claim 1, further comprising a short line to connect the first meander line and the second meander line.

* * * * *